United States Patent [19]

Neufeld

[11] 4,195,431

[45] Apr. 1, 1980

[54] GRAPHIC DISPLAYS EMPLOYING ELECTROLUMINESCENT PANELS

[76] Inventor: Eugene S. Neufeld, 200 W. 86th St., New York, N.Y. 10024

[21] Appl. No.: 859,833

[22] Filed: Dec. 12, 1977

[51] Int. Cl.[2] ..... G09F 13/22

[52] U.S. Cl. ..... 40/544; 40/152.2; 40/367

[58] Field of Search ..... 40/361, 362, 363, 364, 40/365, 366, 902, 544, 152.2, 367; 362/31, 97, 98; 313/495, 513

[56] References Cited

U.S. PATENT DOCUMENTS

| | | | |
|---|---|---|---|
| 1,380,895 | 6/1921 | Gilman | 362/97 |
| 2,294,444 | 9/1942 | Boroughs | 40/362 |
| 2,487,403 | 11/1949 | Wisdom | 362/97 |
| 2,543,670 | 2/1951 | Regensburg | 40/367 |
| 2,716,298 | 8/1955 | Spielmann | 40/544 |
| 2,826,844 | 3/1958 | Leika | 40/902 X |
| 3,680,237 | 8/1972 | Finnerty | 40/544 |
| 4,105,319 | 8/1978 | Wells et al. | 40/363 |

FOREIGN PATENT DOCUMENTS

| | | | |
|---|---|---|---|
| 234615 | 2/1945 | Switzerland | 40/361 |
| 246830 | 10/1947 | Switzerland | 240/98 |
| 893360 | 4/1962 | United Kingdom | 40/366 |

*Primary Examiner*—Louis G. Mancene
*Assistant Examiner*—Wenceslao J. Contreras
*Attorney, Agent, or Firm*—Arthur L. Plevy

[57] ABSTRACT

A booklike article such as a menu, opera score, sports program, theatre program comprises a first relatively transparent layer having impressed thereon indicia representative of graphic data associated with the typical article. Underlying the transparent layer is an electroluminescent panel which upon application of a suitable operating potential, will emit radiation in the light spectrum, thus enabling the grahic data to be viewed in dark environments. A source of potential is located in the spine of the book. The source is battery operated and supplies an output for energizing the panel.

9 Claims, 6 Drawing Figures

A.C. LINE
VOLT MULT.
TO PANEL 23
TO TRANSISTORS 37

GRAPHIC DISPLAYS EMPLOYING ELECTROLUMINESCENT PANELS

BACKGROUND OF INVENTION

This invention relates to illuminated graphic displays and more particularly to a booklike enclosure capable of providing illumination of graphic data employing electroluminescent panels.

The prior art is replete with a variety of devices employing electroluminescent panels or capacitors to illuminate signs, directories and so on. Essentially, such devices as well as applications are located in Class 40, sub-class 130M. Examples of such prior art can be had be referring to patents as U.S. Pat. No. 2,716,298 entitled ILLUMINATED DIRECTORY, U.S. Pat. No. 2,919,366 entitled ELECTRO-LUMINESCENT DEVICES, U.S. Pat. No. 2,922,912 entitled INDICIA BEARING ELECTROLUMINESCENT PANEL AND METHOD OF MANUFACTURE, U.S. Pat. No. 3,102,242 entitled OSCILLATOR WITH ELECTROLUMINESCENT AND PHOTOCONDUCTIVE ELEMENTS, U.S. Pat. No. 3,201,633 entitled ELECTRO-LUMINESCENT CAPACITOR, U.S. Pat. No. 3,580,755 entitled NONFLAMMABLE, THIN, INTEGRALLY ILLUMINATED CONTROL PANEL OVERLAY and others.

In spite of the above structures, there is a need for an illuminated graphic display in a booklike configuration which will enable the lighting of graphic data contained in a menu, a sports program, a theatre program or a similar article. It is common knowledge that many restaurants and similar establishments are extremely dark to preserve atmosphere and so on. It is extremely difficult to read a menu or a theatre program in a darkened environment.

Hence, there is a need for a menu or a booklike apparatus which will contain therein, integral means of illuminating graphic data associated with the particular establishment using the apparatus. In this manner, the user will be able to clearly see and distinguish all items present in the graphic format without resorting to external means of illuminating the same.

It is therefore an object of the present inivention to provide a booklike article employing an integral illumination system for graphic data contained within said book.

BRIEF DESCRIPTION OF PREFERRED EMBODIMENT

An illuminated graphic display apparatus, comprising a booklike apparatus having a centrally located spine member including a hollow inner chamber, a first cover member pivotally coupled to said spine member at a first end and a second cover member pivotally coupled to said spine member at said other end to thus form a book with at least one of said cover members of a sleeve configuration having a slit for insertion therein of a series of planar sheets, said surface of said one cover member having a large aperture for exposing to view one of said sheets when inserted in said cover member, a first planar sheet inserted in said sleeve having located thereon, graphic data to be viewed, said data as positioned on said sheet located within said aperture of said cover member, a planar panel member underlying said first sheet and also inserted in said sleeve, said second planar member comprising an electroluminescent capacitor adapted to emit light when energized for illuminating the graphic data on said first sheet and energizing means located in said hollow inner chamber of said spine member for energizing said second planar member to thereby cause the same to emit light.

DETAILED DESCRIPTION OF DRAWINGS

Figures 1, 1A, 2, 3, 4, 5:
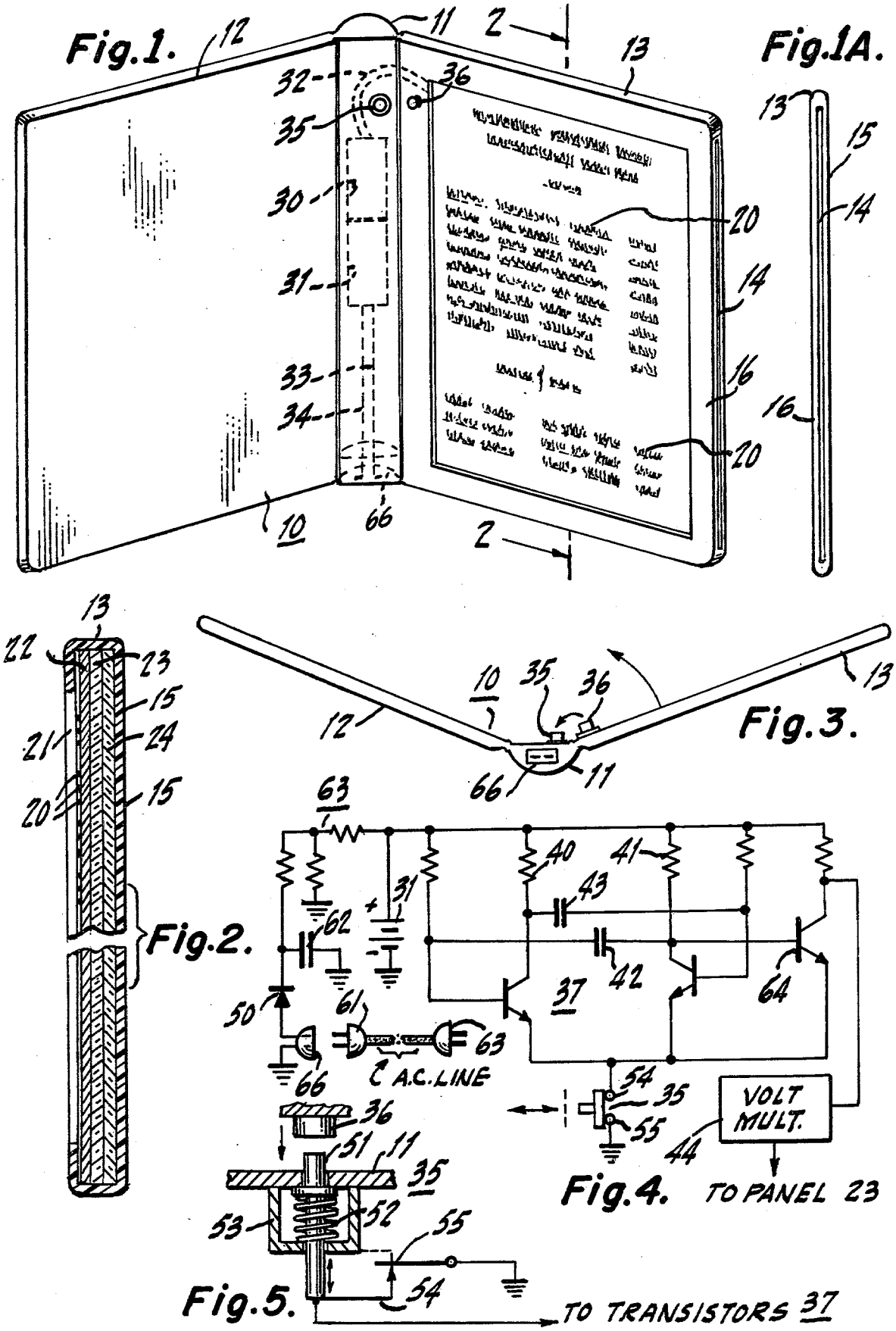
FIG. 1 is a front perspective view of a booklike illuminated apparatus according to this invention.
FIG. 1A is a side view of an information containing panel associated with the booklike structure of FIG. 1.
FIG. 2 is a cross-sectional view taken through line 2—2 of FIG. 1 to show the arrangement.
FIG. 3 is a top view of the booklike article.
FIG. 4 is a circuit schematic of a typical power supply employed in the invention.
FIG. 5 is a schematic diagram of a switch used in conjunction with the invention.

Referring to FIG. 1, there is shown a booklike article 10 which may for example, be a menu, a sports program, a threatre program, an opera score or any other graphic data one would normally expect to find in a booklet configuration as shown. Conventionally, the book contains a spine or center section 11 which is relatively thick.

The spine section 11 as shown in FIG. 3 is relatively thick and has an internal hollow or internal chamber at which can be located a suitable power source as 30, which will be explained subsequently.

Depending from the central section 11 is a front cover section 12 and a back cover section 13. The back cover section is of a sleeve configuration as shown in FIG. 1A and has a slot 14 between a back surface 15 and a front surface 16 of the back cover member 13. Hence, as is apparent, one may slide or remove thin sheets of material by inserting the same through the opening 14 in the sleeve section 13.

As shown in FIG. 1, the front surface of the sleeve section has graphic data 20 immediately visible thus enabling a user to read the items for example, on a menu and the prices or all the typical graphic data that one would expect to be present in a menu format. As will be explained, the graphic data from the menu is formed on a relatively transparent plastic sheet which may be fabricated from a suitable plastic such as polystyrene or mylar.

Essentially, this relatively opaque sheet can have the graphic data impressed thereon by means of an electrostatic photographic process. As is known, any pattern can be produced by means of this process on a suitable plastic or paper sheet. An example of a suitable electrostatic process is employed in copying machines. In essence, a latent image is formed as a charge pattern on a plastic sheet and is made visible during development by having finely divided powders electrostatically attracted to the charge areas. Modern day copying machines will impress graphic data by the copying process on vinyl or plastic sheets and hence, any item such as a menu format and so on can be copied directly on a vinyl sheet.

Referring to FIG. 2, there is shown a cross-sectional configuration of the back cover 13 of the booklet. A first sheet 21 may be fabricated from a clear or colored plastic such as polystyrene or mylar and serves as a protection for a second sheet 22. The sheet 22 is as above indicated, also a plastic sheet and has impressed thereon, the graphic data 20 as indicated above. It is, of course, understood that the graphic data need not be applied by an electrostatic process, but may be printed directly thereon by suitable printing processes employing ink which will adhere to plastic. Such inks and dyes are well known in the art and many examples of plastic materials having various imprints on surfaces thereof are widely known.

Underlying layer 22 is an electroluminescent panel 23. Essentially, the electroluminescent panel is well known. Such panels are basically capacitors which will emit non-thermal light energy when excited by a suitable source. Many materials such as phosphors exhibit the luminescent characteristic.

A luminescent material such as employed in panel 23 may be considered as a transformer of energy and in essence, converts electric potential to photons. Many examples of such materials are well known in the art and common materials such as ZnS, SiGe, CdS, ZnS and so on exhibit such properties. If reference is made to the above noted patents, certain of the same contain descriptions of electroluminescent capacitors which may be employed in operation of this invention.

Essentially, the panel will emit light upon application to the panel of a suitable source of potential. The panel 23 will emit a steady glow at a relatively low intensity; which intensity is, of course, a function of the mangitude and frequency of the applied voltage. The effect is well known and such panels are presently commercially available and are relatively inexpensive while being extremely thin.

Underlying the electroluminescent panel 23 is a back protection panel 24 which may be fabricated from cardboard or paper. As is seen from FIG. 2, the composite structure thus depicted are all contained within the back cover member 13 associated with the book 10.

It is noted that the panel 22 containing graphic data can be easily removed and replaced. It is also understood that the luminescent panel 23 can be glued or permanently secured to the back panel 24 which can be rigidly secured to the cover member 13. Hence, the panel 22 would be the only panel that can be removed through the opening 14 in the cover member 13. In this manner, the operator of a restaurant or any establishment can change the graphic format as often as desired by merely removing the sheet 22 and replacing it with a new format.

Shown in FIG. 1 is a power source 30 and a suitable battery such as 31. The power source and battery 31 are conveniently contained in the thicker spine section 11 of the book. As shown in the FIG., suitable biasing leads or wires 32 are directed from the power source 30 to the luminescent panel 23 for applying an operating potential thereto. The battery 31 employed may be extremely small and a rechargable type such as a nickel cadium cell.

Also shown are two wires 33 and 34 extending from the battery and directed to a connector to enable the operator to charge the battery as often as desired in order to maintain its voltage.

Also shown in conjunction with the menu is a switch device 35. As will be explained, the switch 35 operates to apply potential from the power source 30 to the panel when the menu is opened. When the menu is closed, the power source is inactivated and hence, no energy is consumed in the closed position.

Referring to FIG. 3, there is shown a bottom view of the menu of FIG. 1. As indicated, the spine section 11 contains a suitable power source and battery supply. A socket 66 is shown. Socket 66 enables one to plug the menu into an AC line for charging the battery 31, as will be explained.

Also shown in FIG. 3 is the pressure activated switch 35. Located on the surface of the back cover 13 is a projection 36. This may merely be a raised plastic projection or a raised portion assoicated with the cover 13. As can be seen from FIG. 3, when the book 10 is closed, the projection 36 contacts the switch 35 to activate the same. In this manner, upon closure of the menu, the switch 35 removes power from power source 30. Upon the opening of the book 10, the switch 35 applies power to the panel 23 and thus causes the graphic data located on panel 20 to be illuminated.

Referring to FIG. 4, there is shown a typical circuit for energizing an electroluminescent panel such as 23. It is understood that the cirucit configuration is merely by way of example and numerous other circuits can be employed to generate a suitable waveform at a proper voltage level for activation and excitation of the panel.

In essence, the battery 31 is coupled to a transistor oscillator circuit 37. The oscillator circuit 37 is a well known configuration and is referred to as an astable multivibrator. Essentially, the multivibrator converts the DC battery voltage to a repetitive voltage at the output. The repetitive voltage is of any selected frequency such as 120 Hz for energizing typical commercially available panels as 23. The frequency of operation of the circuit 37 is a function of the magnitudes of the resistors as 40 and 41 in the collector electrodes of the transistors as well as capacitors 42 and 43. It is well known that based on present technology, such oscillators are commercially available in integrated circuit form and as such, are extremely small and reliable in operation.

The output signal from the oscillator 37 is applied to an amplifier transistor configuration 64. The output of transistor 64 may be applied to a voltage multiplier circuit 44. Again, many devices such as transformer, diode circuits and so on are used to raise the potential or the voltage from an oscillator source as 47. These techniques are well known and the potentials at the output of the voltage multiplier 44 is at a frequency and level to completely and efficiently excite the panel 23.

As indicated, connector 66 is shown in FIG. 4. One end of the connector is coupled to the anode of a diode 50. The cathode of the diode is coupled to a capacitor 62 and a resistor network 63 is shown coupled to the battery 31. The circuit thus described is a typical charging circuit for a battery. Hence, by using a connector configuration comprising a male plug 61 connected to another male plug 52, one can now apply line potential to the battery charger via the female circuit 66 to charge the battery as often as necessary.

The oscillator 37 is coupled to ground through the swith 35. Hence, when switch 35 is in the position shown, a circuit path is provided and the oscillator will conduct and operate. When switch 35 is open and corresponding to the closing of the book, the oscillator cannot conduct and no current can flow and hence, the panel 23 will not be illuminated.

FIG. 5 shows one typical construction for the switch 35. In essence, the switch 35 includes a moveble plastic plunger member 51. The member 51 is an elongated member and has a spring 52 which encircles member 51 and is coupled between the top surface of the cover member 13 and a switch housing 53 which is also secured to spine member 11.

A first contact 54 is coupled directly to the opposite end of member 51. A second contact 55 is located and positioned above contact 54 and may be, for example, mechanically coupled to housing 53. It is shown that contact 55 is directed to ground, while contact 54 is directed to the emitter electrodes of the transistors forming the oscillator 37.

Shown located above the plunger 51 is the projection 36. As one can ascertain from FIG. 5, if the projection 36 is not exerting a force on member 51, contact 54 is in contact with contact 55 and there is a ground return for oscillator 37, thus directing power to the panel 23. As soon as the book is closed, member 36 pushes member 51 downwardly. Thus, contact 54 is forced away from contact 55 to open the circuit and no power is dissipated. As soon as the book is opened, the spring 52 which encircles and is coupled to the rod 51 pushes the rod upwards and hence, contact 54 coacts with contact 55 to thus provide power to the panel 23.

It is, of course, understood that many alternate circuit configurations as well as switching devices and so on can be employed to implement the above described invention and all such equivalents are considered to be part and parcel of the same.

It is also understood that the illuminated booklet thus described has a plurality of uses in illuminating items such as menus, sports programs and so on and hence, all such equivalents are deemed to be encompassed within the breadth and scope of this invention as applicable according to the following claims.

I claim:

1. An illuminated graphic display apparatus, comprising:

(a) a booklet apparatus having a centrally located spine member including a hollow inner chamber, a first thin cover member pivotally coupled to said spine member at a first end and a second thin cover member pivotally coupled to said spine member at said other end, to thus form a booklet with at least one of said thin cover members of a sleeve configuration having a slit for insertion therein of a series of planar sheets, said surface of said one cover member having a large aperture for exposing to view one of said sheets when inserted in said cover member, (b) a first planar sheet inserted in said sleeve having located thereon, graphic data to be viewed, said data as positioned on said sheet located within said aperture of said cover member, said graphic data impressed thereon by an electrostatic process, (c) a second planar panel member underlying said first sheet and also inserted in said sleeve, said second planar member comprising an electroluminescent capacitor adapted to emit light when energized for illuminating the graphic data on said first sheet, and (d) energizing means including an oscillator adapted to provide a repetitive waveform when energized by a battery located in said hollow inner chamber of said spine member for energizing said second planar member to thereby cause the same to emit light.

2. The display apparatus according to claim 1 wherein said first sheet comprises a relatively clear plastic sheet having graphic data located thereon.

3. The display apparatus according to claim 1 wherein said means located in said hollow inner chamber includes a rechargeable battery source.

4. The display apparatus according to claim 1 further including switching means coupled to said energizing means and operative to apply power to said panel via said switching means when said first and second cover members are in an opened position and to remove power when said first and second members are in a closed position.

5. The display apparatus according to claim 3 further including means for charging said battery located in said hollow inner chamber, and connector means for applying a charging source to said means.

6. The display apparatus according to claim 1 further comprising a third sheet of a clear material located to cover said large aperture of said cover member to protect said first sheet as inserted in said sleeve.

7. The display apparatus according to claim 1 wherein said graphic data is located on said first sheet by an electrostatic process.

8. The display apparatus according to claim 1 wherein said graphic data is printed on said first sheet.

9. The display apparatus according to claim 1 wherein said graphic data is indicative of a menu format.

* * * * *